US005346212A

United States Patent [19]

Kuebler

[11] Patent Number: 5,346,212

[45] Date of Patent: Sep. 13, 1994

[54] RACKET FOR BALL GAMES AND STRING PORTION OR STRING THEREFOR

[76] Inventor: Siegfried Kuebler, Mozartstr. 17, W-7770 Überlingen, Fed. Rep. of Germany

[21] Appl. No.: 16,530

[22] Filed: Feb. 11, 1993

[30] Foreign Application Priority Data

Mar. 9, 1992 [DE] Fed. Rep. of Germany ..... 4207377
Aug. 4, 1992 [DE] Fed. Rep. of Germany ..... 4225669

[51] Int. Cl.[5] ..... A63B 51/02
[52] U.S. Cl. ..... 273/73 D; 273/73 R
[58] Field of Search ..... 273/73 R, 73 C, 73 D

[56] References Cited

U.S. PATENT DOCUMENTS

| | | | |
|---|---|---|---|
| 1,132,214 | 3/1915 | Ries et al. | 273/73 D |
| 3,023,483 | 3/1962 | Steiner | 273/73 D |
| 4,033,582 | 7/1977 | Linden | 273/73 D |
| 4,330,932 | 5/1982 | Ferrari | 273/73 D |
| 4,339,130 | 7/1982 | Husted | 273/73 R |
| 4,408,760 | 10/1983 | Ferrari | 273/73 D |
| 4,462,591 | 7/1984 | Kenworthy | 273/73 D |
| 4,593,905 | 6/1986 | Abel | 273/73 D |
| 4,685,676 | 8/1987 | Boden | 273/73 D |

FOREIGN PATENT DOCUMENTS

| | | | |
|---|---|---|---|
| 3918421 | 12/1989 | Fed. Rep. of Germany | 273/73 D |
| 899972 | 6/1945 | France | 273/73 R |
| 0149157 | 8/1984 | Japan | 273/73 R |
| 409924 | 5/1934 | United Kingdom | 273/73 D |
| 2167310 | 5/1986 | United Kingdom . | |

*Primary Examiner*—William E. Stoll
*Attorney, Agent, or Firm*—Bachman & LaPointe

[57] ABSTRACT

In an racket for ball games, in particular a tennis racket, having a stringing surface which is provided in a stringing frame and comprising mutually crossing strings as sections of at least one longer string portion the strings in one direction have different cross-sections from the middle region of the stringing surface to the shortest string in that direction. The strings themselves have cross-sections which, from the corresponding central axis of the stringing surface, increase or decrease in a plurality of steps to the shortest string in this direction.

16 Claims, 9 Drawing Sheets

RACKET FOR BALL GAMES AND STRING PORTION OR STRING THEREFOR

BACKGROUND OF THE INVENTION

The invention concerns a racket for ball games, in particular a tennis racket, having a stringing surface which is provided in a stringing frame and which comprises mutually crossing strings which are possibly sections of at least one longer string portion. The invention also concerns the configuration of a string portion or a string per se.

Such a tennis racket, as is described for example in the present applicant's German patent specification No 34 34 898, with a longest string of 330 mm, which extends parallel to the longitudinal axis of the racket, is strung for example at a tension of about 30 kg. That loading is preset on a tensioning machine. If that string were to be measured in the strung racket, for example using a wire strain gauge, the actual tension is always set to a substantially lower value as the string yields due to the material used, in itself or due to the mechanical play in the machines and the tensioning collet. On the basis of experience, the actual value is about 70% of the set tension value, that is to say in this case about 21 kg.

Now it is possible to select for example a 1.3 mm thick gut string which, assuming ball impact, absorbs 2 kg. It is therefore tightened from 21 to 23 kg and the increase in stretch is 8.25%–7.5%, that is to say 0.75%, relative to the length of 330 mm, consequently 2.47 mm. The string which is most closely adjacent thereto in parallel relationship is still 320 mm in length and would only want to increase in length by 2.4 mm. And in actual fact, if all strings are intended to yield to the same degree, it would have to be less heavily tensioned.

A disadvantage in regard to those considerations is that, with such a mode of stringing, the stringing machine must be set to a new value for each string length. In addition, it is then no longer possible in practice to rely on the relatively simple stringing instructions from the individual manufacturers.

Also known in the state of the art is a racket stringing arrangement comprising a plurality of longitudinal and transverse strings of thicker cross-section, which form the middle of the racket, and thinner strings which extend outside the usual impact area, that is to say in the corner surfaces defined by the cross-shaped surface formed by gut strings, and which consist of a different material, in order to take account of the increased loading in the impact area or "sweet spot", by virtue of thicker strings, and in order to have to replace only the strings in the sweet spot, in the event of wear.

In consideration of those factors, the inventor set himself the aim of providing an ideal stringing arrangement for a racket of the kind set forth above, which avoids the above-discussed measures. In addition the invention seeks to provide that the striking performance of the racket in general is improved.

SUMMARY OF THE INVENTION

That object is attained by the teaching set forth herein.

In accordance with the invention, the strings in one direction of the string portion, for example starting from the corresponding center line of the stringing surface, are of different cross-sections towards the shortest string in that direction. In the selected example involving a gut string, a somewhat thinner string which yields a little more is used as such a most closely adjacent string; in this case, with decreasing string length, from frame bore to frame bore, the string cross-section decreases in an outward direction.

In contrast, when using string portions of plastic material and in particular when using nylon strings, the string diameter must increase, with decreasing string length.

Therefore the arrangement uses string portions of a longitudinal section which is of a conical configuration overall or in part, preferably from the middle of the string portion towards both sides; within the stringing surface, the strings afford an increase in cross-section when they are of nylon or a reduction in cross-section when they are of gut, from the center of the stringing arrangement in an outward direction. The precise arrangement of the conical configuration in longitudinal section along the length of the string portion, which conical configuration may be stepless or stepped, depends on the mode of stringing. In regard to the transverse string, the middle does not always have to be the ideal starting point; it could certainly be somewhat closer to the throat of the racket. The string could for example also merely partially increase or decrease (or vice-versa) from the throat to the head, and thus contribute to the desired displacement of what is known as the sweet spot. At any event, in this case the string portion itself affords a varying cross-sectional shape.

In another way of attaining the object, the cross-sections of individually strung strings increase or decrease from the center of the racket outwardly, preferably in steps corresponding to the number of strings, for example about eight.

In principle therefore the inventive concept is that the effect of the action of the ball at the different spacings from the axes of the plane of the stringing arrangement, and thus at different string lengths, is counteracted by differentiated and deliberate and specific variations in cross-section.

The present invention also includes a string of corresponding shape, which is for example ground in a conical or taper configuration.

BRIEF DESCRIPTION OF THE DRAWINGS

Further advantages, features and details of the invention will be apparent from the following description of preferred embodiments and with reference to the drawings in which.

DETAILED DESCRIPTION OF PREFERRED EMBODIMENTS

Figure 1:
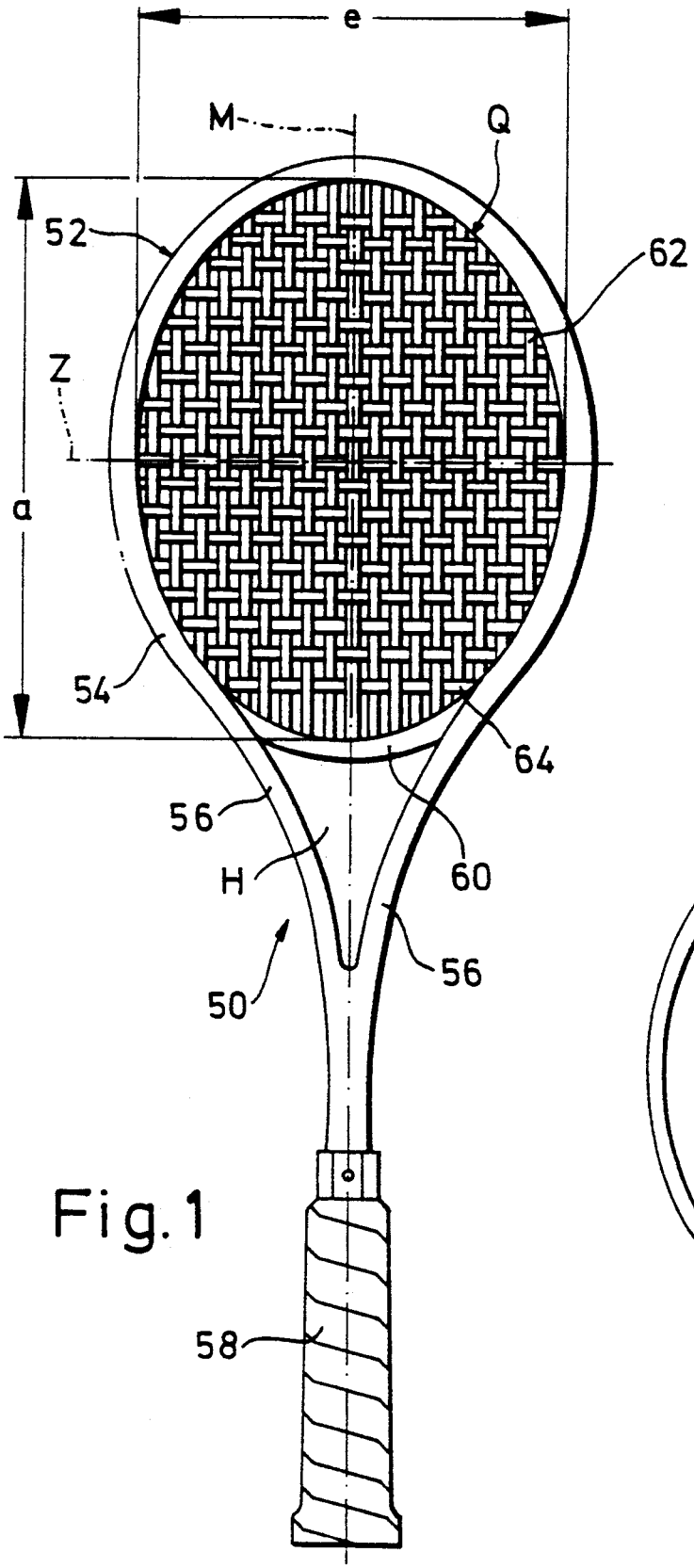
FIG. 1 is a plan view of a tennis racket with a stringing arrangement comprising longitudinal and transverse strings.

A tennis racket 50 has an oval stringing frame 52 comprising a suitably curved shaped bar 54 which on both sides of the longitudinal axis M of the racket goes into a pair of shaped arms 56 which flank an open throat zone H. The shaped arms 56 terminate in a handle 58. The open throat zone H is defined by a transverse limb portion 60 which complements the stringing frame 52, to define the oval configuration.

Figure 2:
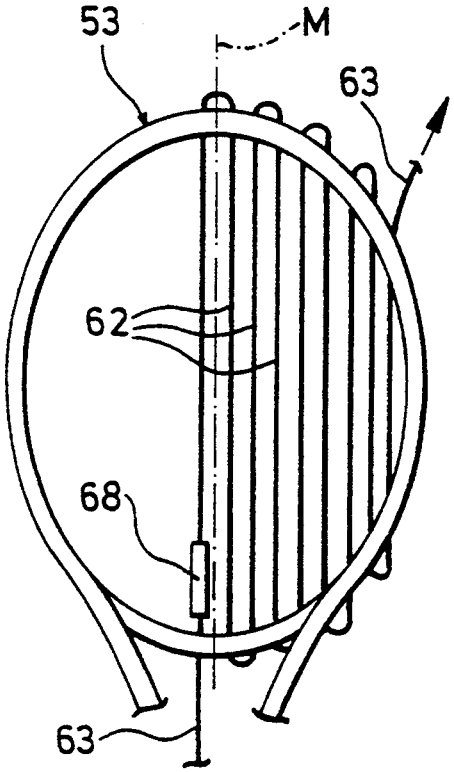
FIG. 2 shows a part of the tennis racket during a stringing operation for longitudinal strings.

A stringing surface or area Q is formed in the manner of an interwoven lattice or grid in the stringing frame 52 by longitudinal strings 62 and transverse strings 64 which cross the longitudinal strings 62. The visible longitudinal strings 62 and transverse strings 64 are respective sections of a longer string portion, as is identified by 63 for example in FIG. 2 in respect of the longitudinal strings 62; the string portion is pushed with both ends from the stringing frame head 53 through bores or holes (not visible) in the frame and for example centrally oriented. Then one side or run of the string portion 63 is fixed by means of a collet 68 and the side which is at the right in FIG. 2 is pulled into place and that is then followed by the left-hand side of the stringing Q.

The longitudinal strings 62, and possibly additionally some transverse strings 64, or the transverse strings are here sections of a string portion 63 or 65 which, as stated, is passed through the holes in the stringing frame 52 or transverse limb portion 50 respectively and which then provides the individual string lengths; in this case the longest longitudinal string 62, actually the longest section of string parallel to the longitudinal axis M of the racket, measures 330 mm (dimension a in FIG. 1); the length of the transverse strings 64 parallel to the transverse axis Z of the racket is identified by e.

So that that tennis racket 50 can be strung for example at a tension of 30 kg (as the reference or desired tension in kilograms), that tensioning force is set on the stringing machine (not shown). The actual tension is the tension of the strings 62, 64 in kg, which exists after the stringing operation and multiple impact of the ball against the strings, and is always at a considerably lower value than the reference or desired tension; the string 62, 64 yields for example due to the material involved or for instance due to the mechanical play in the tensioning machine and the tensioning operation. The actual tension is ascertained by a wire strain gauge or the like.

Thus there is a loss quotient as between the actual tension and the desired or reference tension of about 0.70 to 0.76 in the case of the longitudinal strings 62, in which case it is possible to calculate for example from $0.70 \times 30 = 21$ kg tensioning force. As a result of the oval shape of the tennis racket 50, the loss quotient of the transverse strings 64 deviates somewhat and is 0.50 to 0.60 in the case of conventional rackets.

When a ball impacts against the stringing, the entire stringing surface or area Q is involved to a greater or lesser extent, the greatest effect occurring when the ball impacts at the geometrical center of the racket. With a value of 20 kg impact, of a normal ball from base line to base line, the stringing surface or area Q yields in such a way that for example a selected gut string of a diameter of 1.3 mm, for a load impact of 2 kg, experiences in this case a stretch increase of 8.25–7.5%, that is to say 0.75%, relative to the length of 33 cm, that is to say 2.47 mm.

Figure 3:
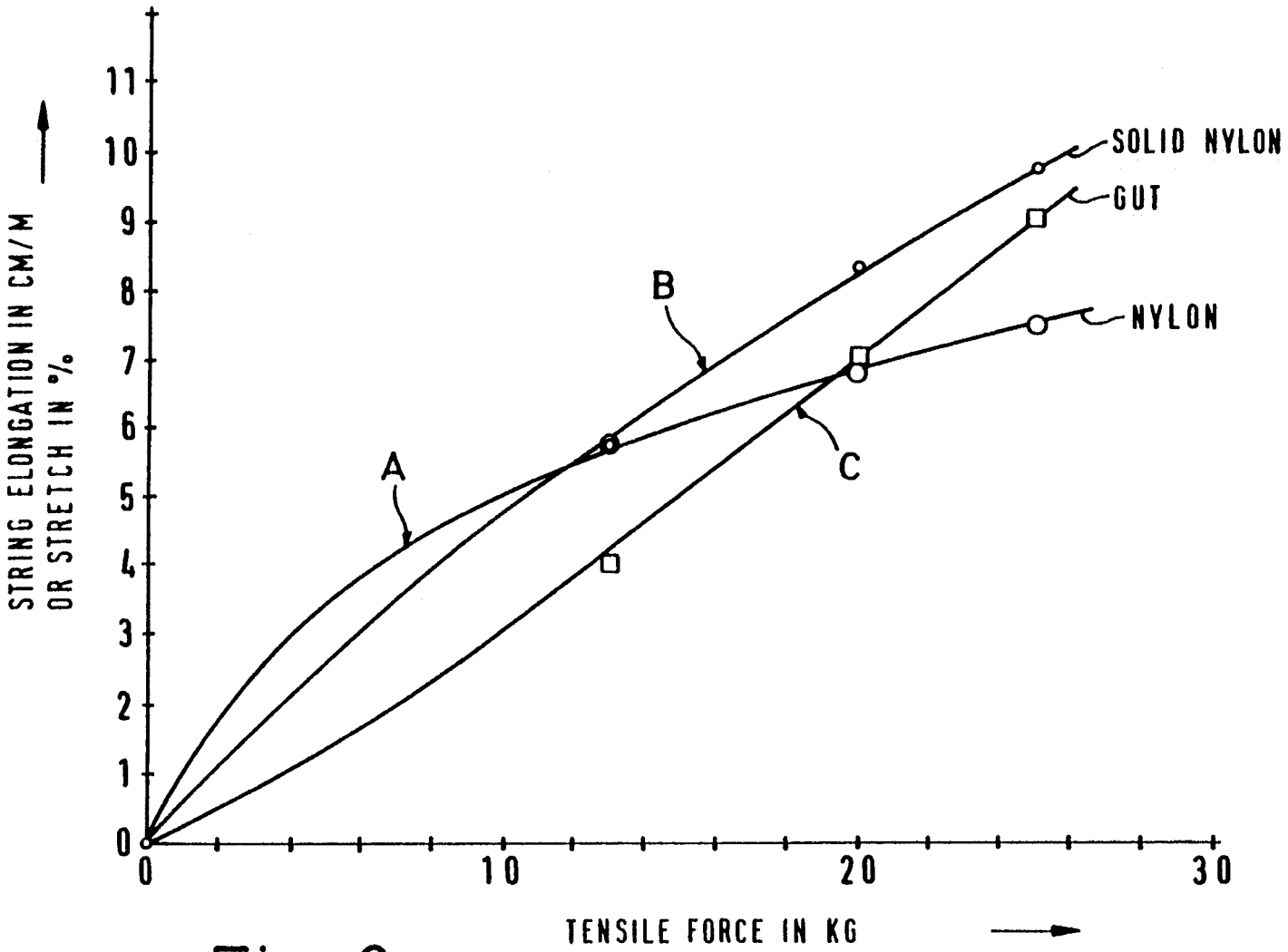
FIG. 3 shows a graph for three different string materials with string elongation or stretch in relation to the tensile force.

FIG. 3 shows, in relation to the tensile force in kg for different kinds of strings, the string elongation in cm/m or the degree of stretch in %, relative to each other, more specifically for the following:

A=Nylon (twisted);

B=Angler's line (solid nylon);

C=Gut.

Figure 4:
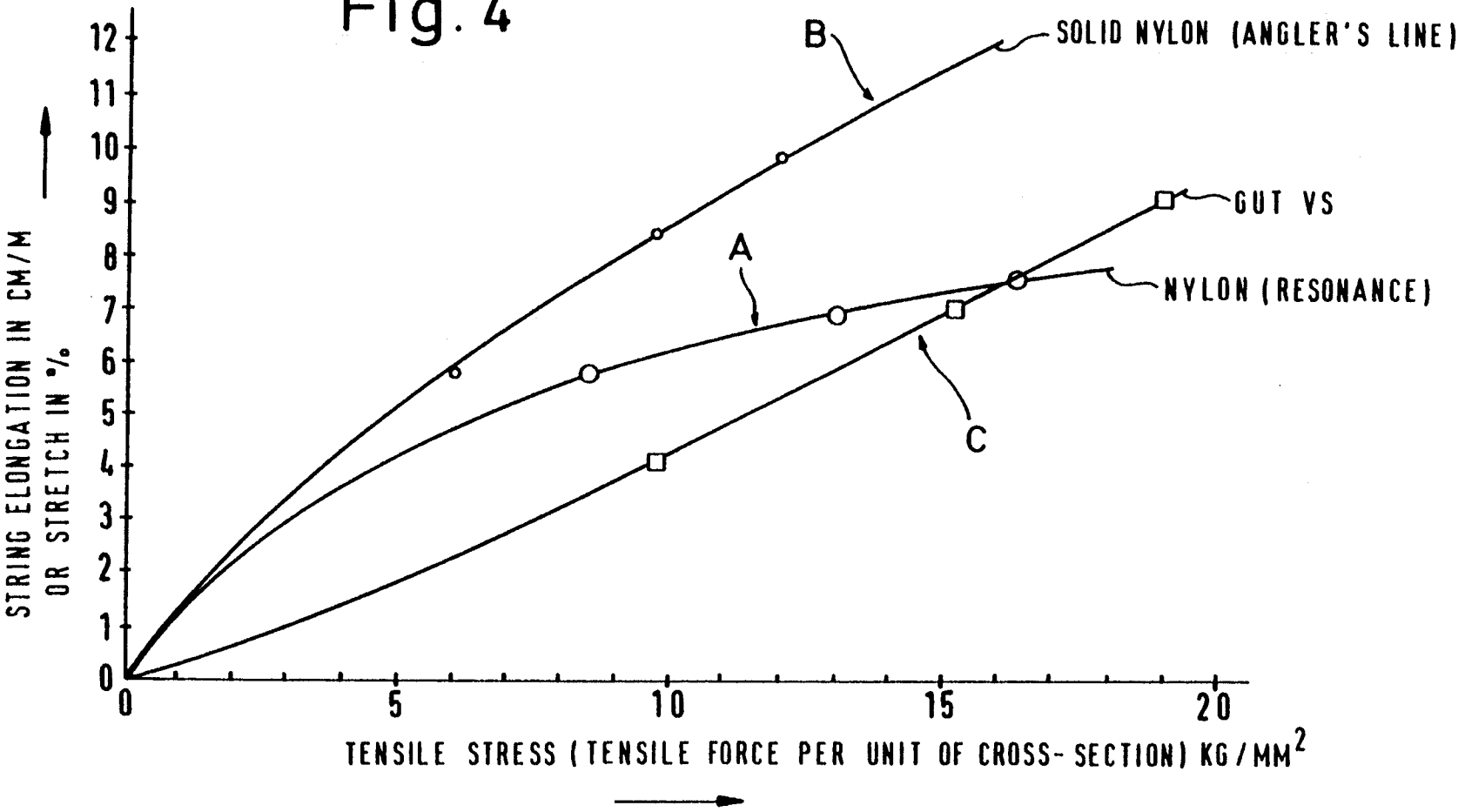
FIG. 4 shows a graph for the string materials shown in FIG. 3 with string elongation or stretch in relation to tensile stress, that is to say the tensile force per unit of cross-section.

In that respect FIG. 4 shows the string elongation or stretch as above, but in this case in relation to the tensile stress in kg/mm2 as tensile force per unit of cross-section.

In the tennis racket 50, the strings 62 and 64 respectively are of different diameters; in the case of the gut string C, starting from the point of intersection of the axes M, Z, a string of smaller diameter is used as the string which is respectively disposed in parallel adjacent relationship towards the stringing frame 52, as that string yields somewhat more.

In order to achieve the above-mentioned elongation of 2.47 mm, even with a string length of 320 mm, the degree of stretch is to be selected at a higher value, for example:

$$\frac{2.47}{2.4} \times 0.75 = 0.775$$

Figure 5:
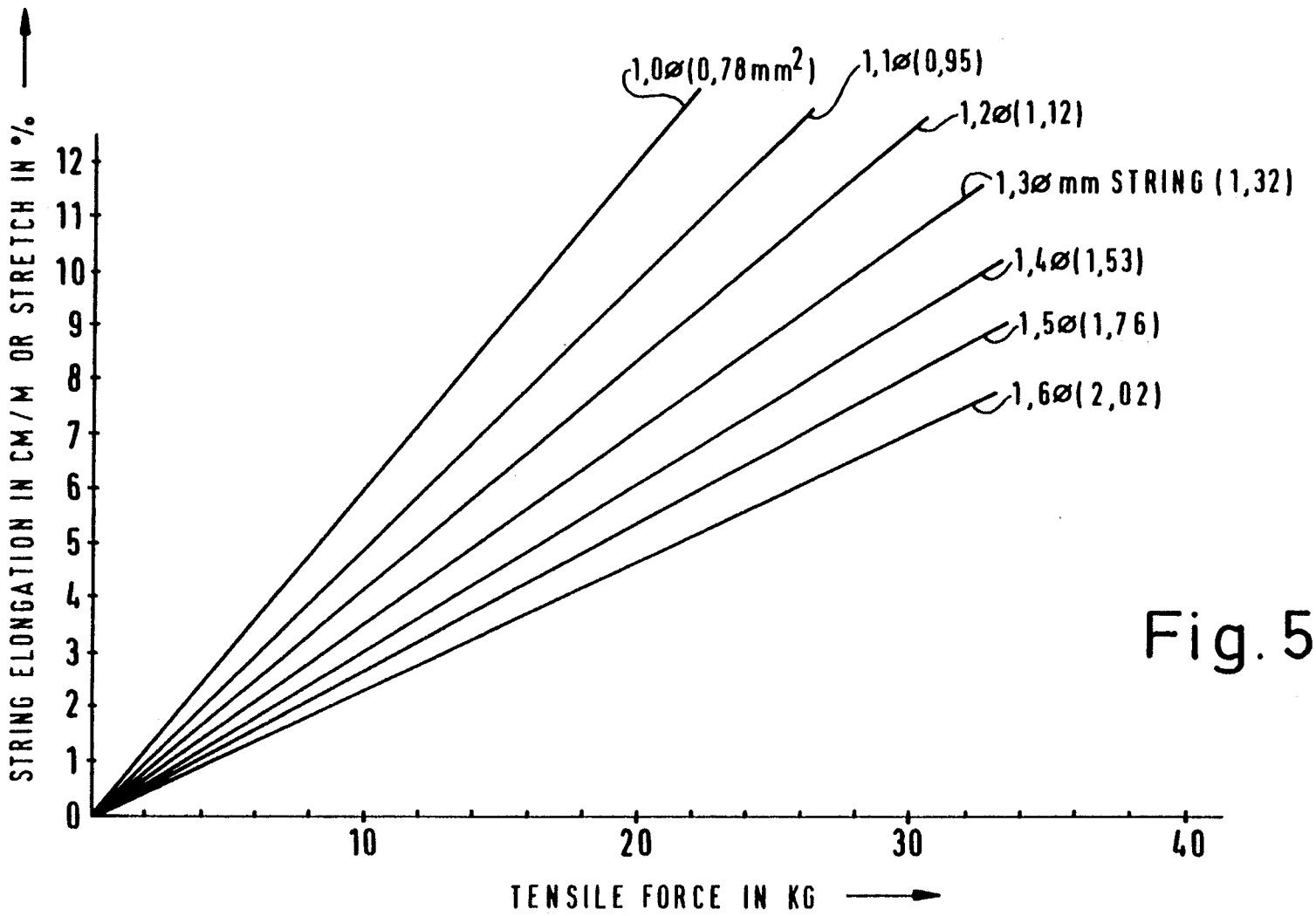
FIG. 5 shows a graph with curves for gut strings of different diameters with string elongation or stretch in relation to tensile force.

For that purpose the string thickness for the gut string is read off from the graph in FIG. 5 (of a thickness of around 1.27 mm); that graph gives the string elongation in cm/m in relation to the tensile force in kg, in which respect it is assumed for the sake of simplification that the stretch is proportional to the tensile force.

The shortest longitudinal string 62 is assumed to be only 21 cm in length. It requires a stretch which would be 1.57 times higher (33/21), that is to say $0.75 \times 1.57 = 1.18$ (what is read off therefore is a string of a diameter of 1 mm). Consequently, what would be correct here would be a string which would be 1.3 mm in the middle and which would measure 1.0 mm at the ends.

The decrease could be linear in accordance with an established curve or in steps.

In practice, the arrangement will begin with a somewhat thicker string at the middle, for example 1.45 mm in diameter, which then goes down to 1.15 mm, or from 1.4 mm to 1.2 mm.

Figure 6:
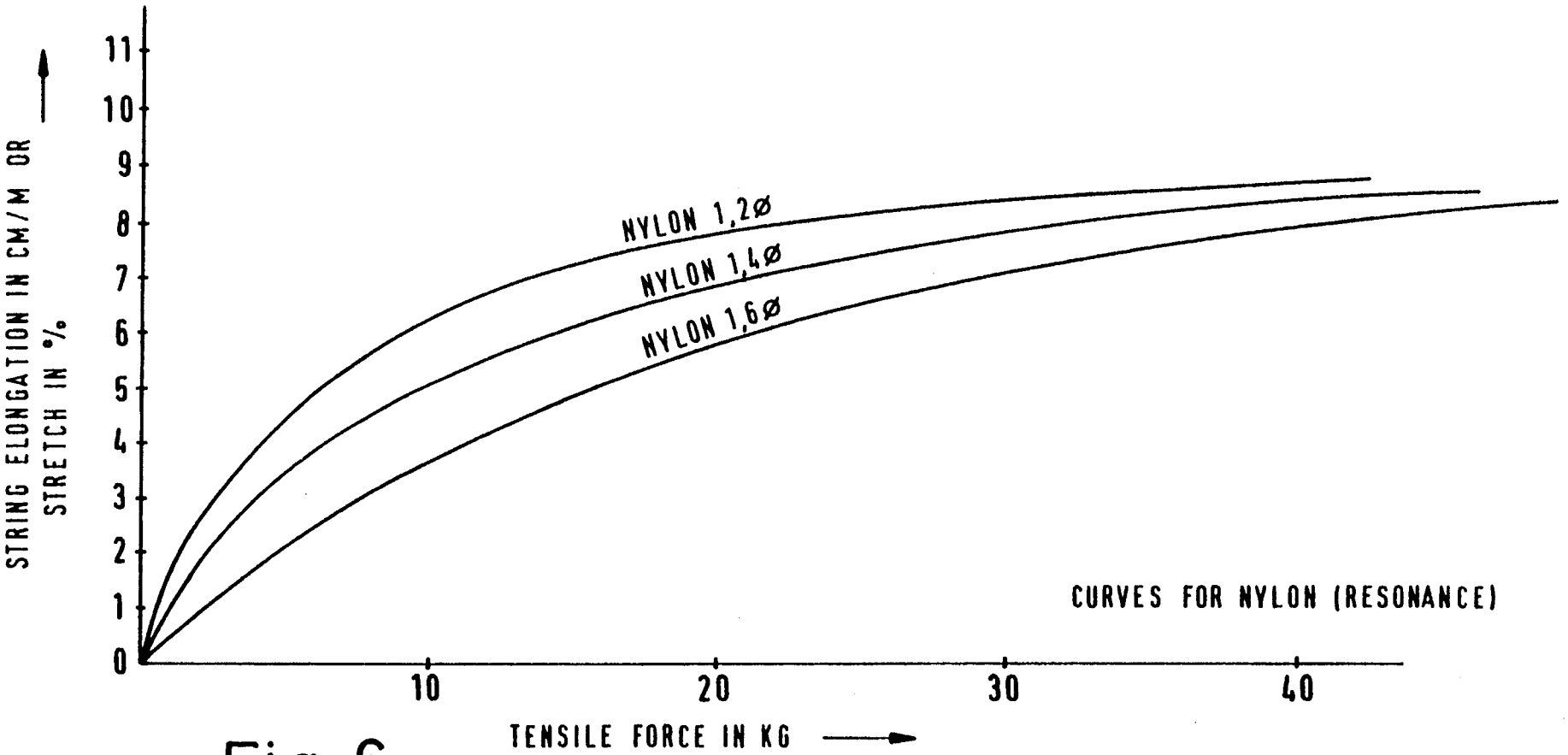
FIG. 6 shows a graph for nylon strings of different diameters with string elongation or stretch in relation to tensile force.

The quite detailed manner of stepping is adapted to the racket geometry, in accordance with the material properties. As a comparison of FIGS. 5 and 6 shows, the gut string C behaves substantially linearly whereas nylon strings A, as shown in FIG. 6, do not behave in terms of their stretch increase proportionally to the increase in force.

The corresponding conditions apply in regard to the transverse string 64. As the tension is lower than in the longitudinal strings 62, advantages could be achieved by virtue of the fact that it is overall somewhat thicker or overall somewhat thinner but otherwise of similarly variable diameters.

On the basis of the stretch/force curve relationship, a reverse construction applies in regard to nylon strings A, that is to say the strings for the longest strings must be thinner than those for the short strings (string sections).

Figure 7:
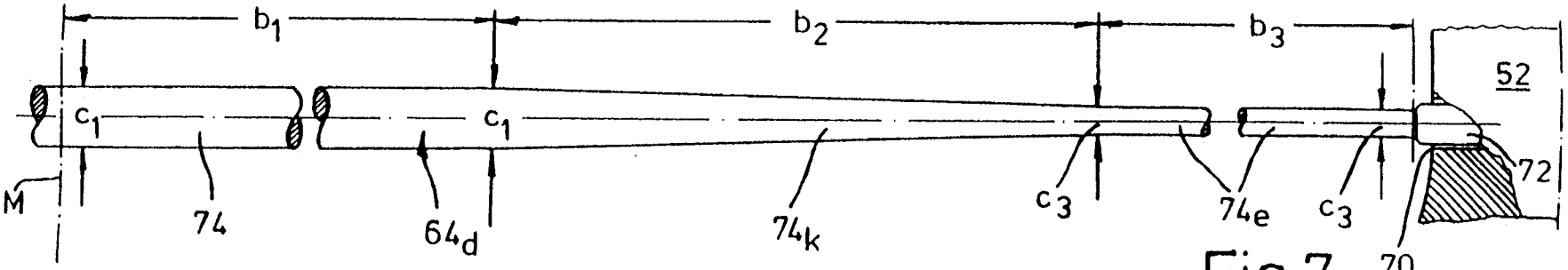
FIG. 7 is a side view of half of a tensioned transverse string of gut.

FIG. 7 shows a side view on a greatly enlarged scale by way of example of one half of a tensioned transverse string 64*d* of gut between the longitudinal axis M of the racket and the stringing frame which is only indicated at 52, with a plastic sleeve or grommet 72 disposed in a bore 70; the longitudinal axis M of the racket is the line of symmetry in respect of the transverse string 64*d*. Extending on both sides of the line of symmetry M is a string section 74 which is close to the axis, of a length b1 of approximately 50 mm, and of uniform diameter as indicated at c1, followed by a conical or tapering string section 74*k* of a length indicated by way of example at b2 of 40 mm which then goes into an end section 74*e* of a length b3 of 40 mm, of uniform diameter as indicated at c3.

Figure 8:
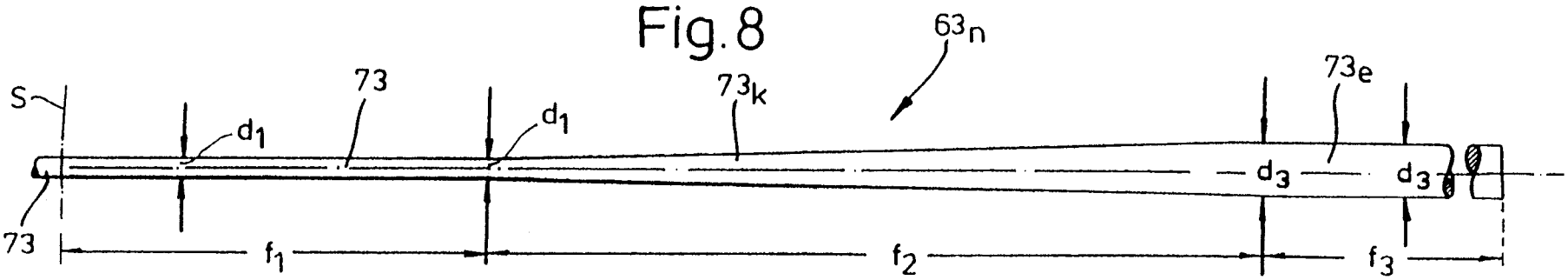
FIG. 8 is a side view of half of a longitudinal string portion of nylon material.
Figure 9:
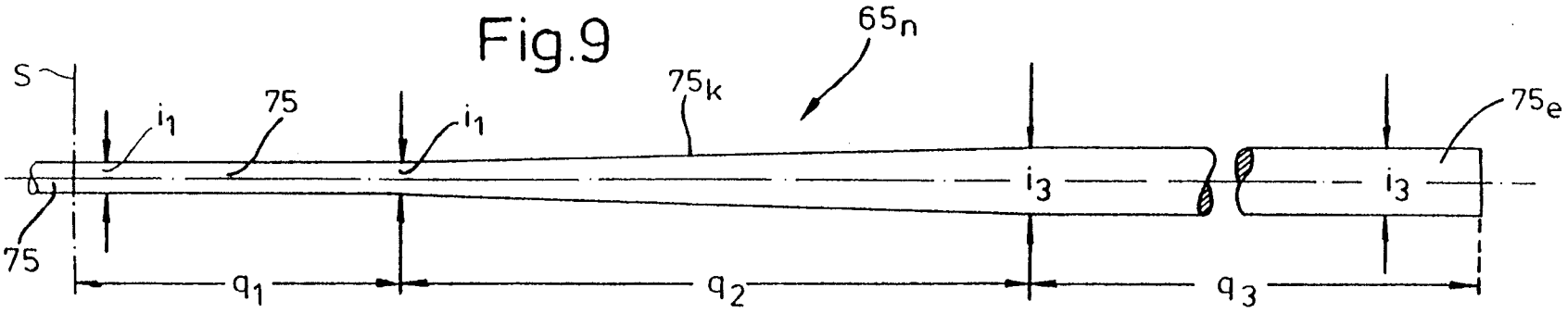
FIG. 9 is a side view of half of a transverse string portion of nylon material.

Unlike the section of a gut transverse string 64*d*, which extends between the longitudinal axis M of the racket and the frame 52, FIG. 8 is a diagrammatic view on an enlarged scale of half of a string portion 63*n* for longitudinal strings of nylon material of a total length of 6120 mm; shown here at the left is a line S as the assumed middle of the string portion and the axis of symmetry in regard to the design configuration of the string portion 63. Extending from the line S at each side thereof is a respective section 73 which is adjacent the center, of a length f1 of 700 mm and a diameter d1 of 1.20 mm, which is followed by a conical or tapered section 73*k* of a length f2 of 1260 mm, the end diameter of which is the diameter d3 of an end section 63*e* of a length f3 of about 1100 mm. That diameter d3 of 1.40 mm remains constant over the length of the end section.

The string portion 65*n* for transverse strings of nylon material of a total length of 5400 mm also has a line S as the notional string center and axis of symmetry. The diameter i1 of its sections 75, which are close to the middle, of a length q1 of 500 mm, measures in this case 1.35 mm, while opposite thereto is the diameter i3 of a dimension of 1.55 mm of the end section 75*e* at the other end of the conical or tapered section 75*k* of a length q2 of 960 mm. The diameter i3 of the end section 75*e* of the string portion 65*n* of the transverse strings also remains constant over its length q3 of about 1240 mm.

Figures 10, 11, 12, 13, 14:
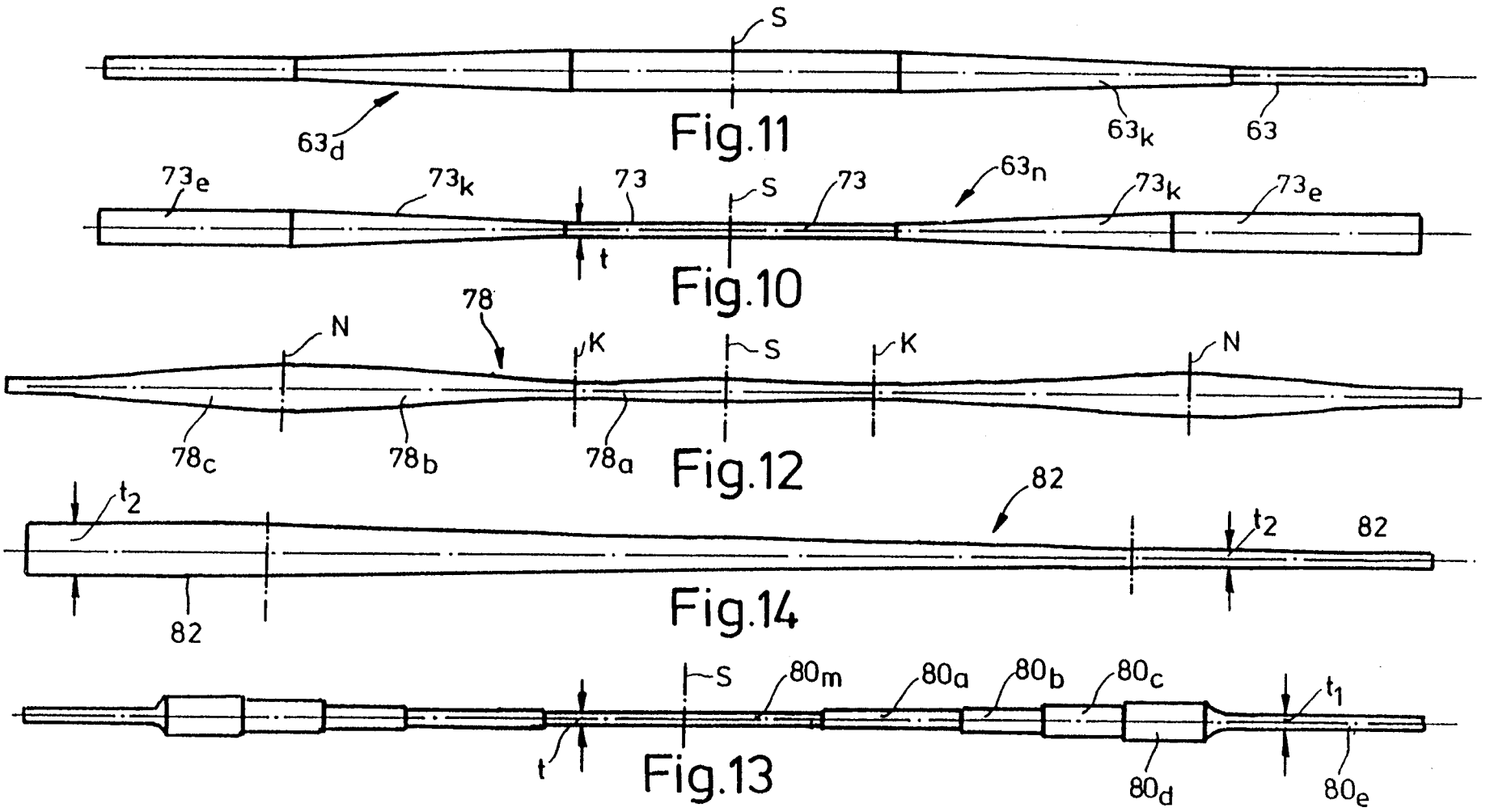
FIGS. 10–14 are side views of string portions shown in very highly diagrammatic form.

FIGS. 10–14 diagrammatically reproduce the configuration of various string portions, FIG. 10 showing the entire length of the string portion 63*n* in FIG. 8 of nylon material and FIG. 11 showing a string portion 63*d* of gut, which tapers on both sides of the line of symmetry S in the region of conical or tapered sections 63*k*, towards its end sections 63*e*. The string portion 78 has cross-sectional maxima both at the line of symmetry S and also at both sides thereof at respective lines N, the dimensions at the lines N being of approximately double the dimension of the middle maximum line S.

FIG. 13 shows a string portion 80 which, at each side of the line of symmetry S and starting from a middle part 80*m*, is stepped four times (80*a*–80*d*) with increasing cross-section, towards an end part 80*e*; the diameter t1 of the end part 80*e* approximately corresponds to that of the middle part 80*m*.

Finally, FIG. 14 provides a conical or tapered intermediate part between two end sections of different constant diameters.

Figure 15:
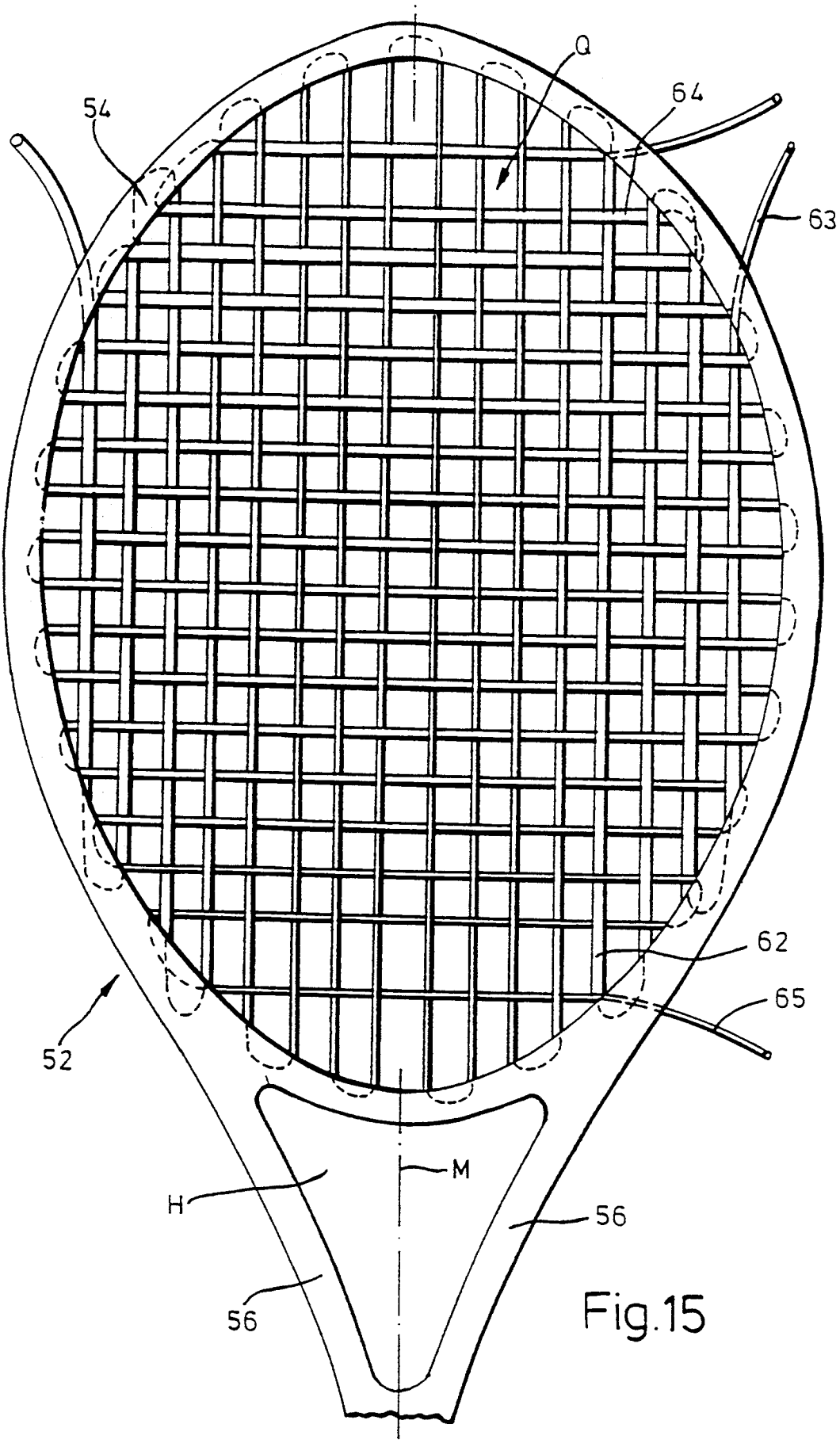
FIGS. 15 and 16 are plan views of stringing areas of rackets.

In the stringing surface or area Q in FIG. 15, such a string portion as is shown in FIG. 14 is indicated for the transverse strings 64, whereas the string portion for the longitudinal strings 62 corresponds to that shown in FIG. 10.

Figure 16:
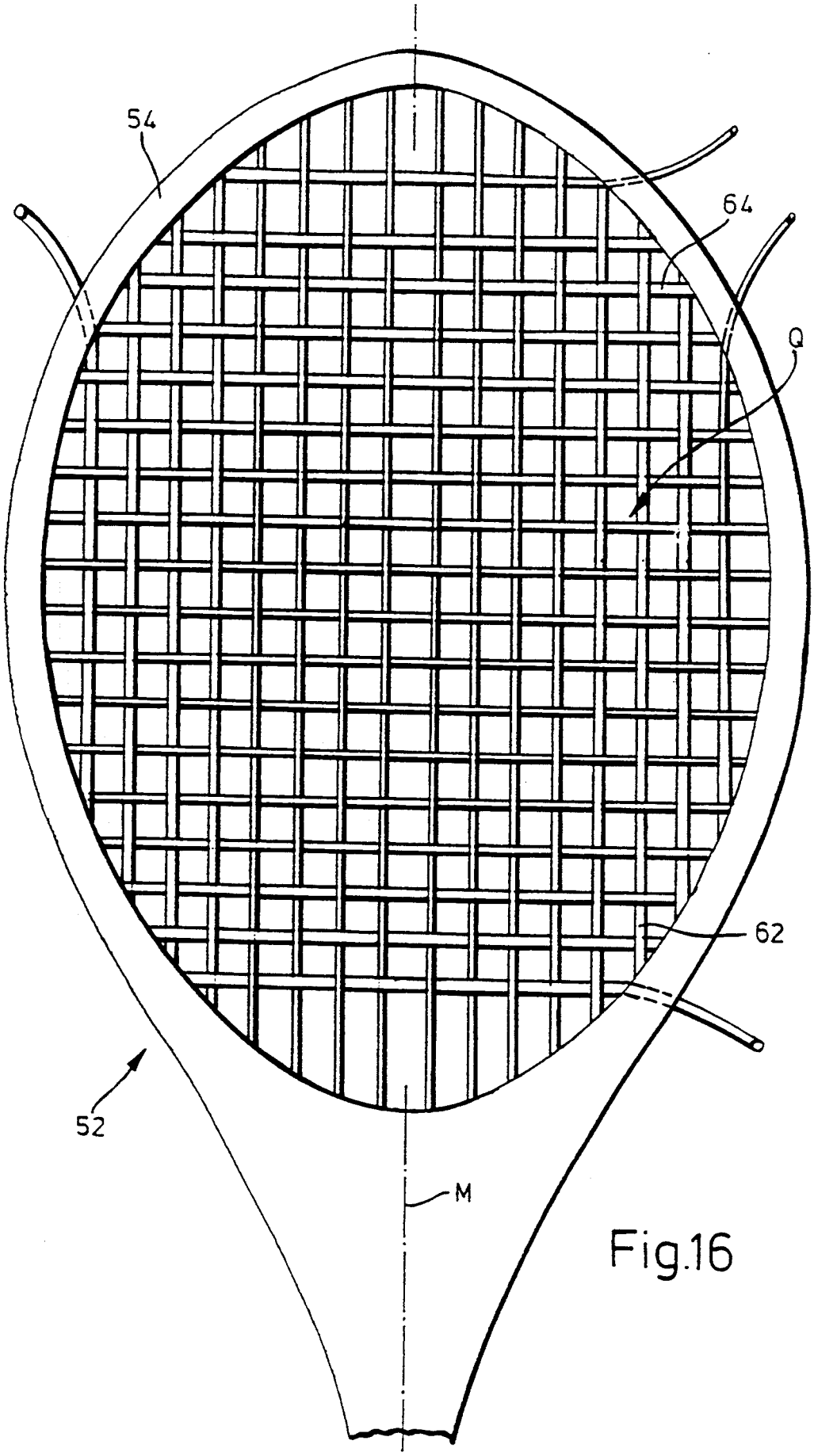

FIG. 16 shows a stringing frame 52 with closed throat, with a stringing arrangement Q in which the strings markedly decrease from the center outwardly.

I claim:

1. A racket for ball games, which comprises: a stringing frame having a string area with a middle region thereof; a stringing surface in said frame comprising mutually crossing string lengths in a first and second direction, wherein said string lengths are sections of at least one longer string portion, at least some of said string lengths having different lengths in said frame; wherein said string sections in one direction in the middle region of said stringing surface have different cross-sections than the shortest string section in said direction; and wherein at least one of said string portion and string section is of varying cross-section.

2. A racket according to claim 1 wherein at least one of said string portion and said string section includes a conical longitudinal shaped section.

3. A racket according to claim 1 wherein said crossing string sections are in the form of a gut string, wherein the diameter of at least one of said string portion and string sections decreases towards the ends thereof.

4. A racket according to claim 3 wherein the cross-section of at least one of said string portion and string section changes from the middle thereof.

5. A racket according to claim 1 wherein said crossing sections are of plastic material, wherein the diameter of at least one of said string portion and string sections increases towards the ends thereof.

6. A racket according to claim 1 wherein said racket is a tennis racket.

7. A racket for ball games, which comprises: a stringing frame having a stringing area with a middle region thereof; a stringing surface in said frame having central axes thereof comprising mutually crossing, longitudinal and transverse strings in a first and second direction, with the centermost string being adjacent the corresponding central axis, at least some of said mutually crossing strings having different lengths in said frame; wherein the strings in one direction of said stringing surface have cross-sections which, from the corresponding central axis of the stringing surface at least one of increase and decrease to the shortest string in said direction; and wherein one of the strings have ends and a longitudinal conical shape from one end to the other end.

8. A racket according to claim 7 wherein said racket is a tennis racket.

9. A racket for ball games, which comprises: a stringing frame having a stringing area with a middle region thereof; a stringing surface in said frame having central axes thereof comprising mutually crossing, longitudinal and transverse strings in a first and second direction, with the centermost string being adjacent the corresponding central axis, at least some of said mutually crossing strings having different lengths in said frame; wherein the strings in one direction of said stringing surface have cross-sections which, from the corresponding central axis of the stringing surface at least one of increase and decrease to the shortest string in said direction; and including gut strings with a plurality of longitudinal strings and a plurality of transverse strings, wherein at least one string of said plurality comprises a string section which has a decreasing cross-section from its middle towards its two ends.

10. A racket according to claim 9 wherein said racket is a tennis racket.

11. A racket for ball games, which comprises: a stringing frame having a stringing area with a middle region thereof; a stringing surface in said frame having central axes thereof comprising mutually crossing, longitudinal and transverse strings in a first and second direction, with the centermost string being adjacent the corresponding central axis, at least some of said mutually crossing strings having different lengths in said frame; wherein the strings in one direction of said stringing surface have cross-sections which, from the corresponding central axis of the stringing surface at least one of increase and decrease to the shortest string in said direction; including plastic strings with a plurality of longitudinal strings and a plurality of transverse strings, wherein at least one string of said plurality comprises a string section which has an increasing cross-section from its middle towards both ends.

12. A racket according to claim 11 wherein said racket is a tennis racket.

13. A racket for ball games, which comprises: a stringing frame having a stringing area with a middle region thereof; a stringing surface in said frame having central axes thereof comprising mutually crossing, longitudinal and transverse strings in a first and second direction, with the centermost string being adjacent the corresponding central axis, at least some of said mutually crossing strings having different lengths in said frame; wherein the strings in one direction of said stringing surface have cross-sections which, from the corresponding central axis of the stringing surface at least one of increase and decrease to the shortest string in said direction; including gut strings and including also a string section of uniform cross-section, and adjacent the said section of uniform cross-section is a string section of longitudinal conical shape.

14. A racket according to claim 13 wherein said racket is a tennis racket.

15. A racket according to claim 13 wherein adjacent the conical shape at the end thereof of larger cross-section is a section of equal cross-section.

16. A racket according to claim 13 wherein adjacent the conical shape at the thin end thereof is a section which is of uniform cross-section.

* * * * *

UNITED STATES PATENT AND TRADEMARK OFFICE

CERTIFICATE OF CORRECTION

PATENT NO. : 5,346,212

DATED : September 13, 1994

INVENTOR(S) : Siegfried Kuebler

It is certified that error appears in the above-identified patent and that said Letters Patent is hereby corrected as shown below:

In Column 6, claim 1, line 20, after "wherein" "said" should read --the--.

In Column 6, claim 7, line 54, after "wherein" "one" should read --each--.

In Column 7, claim 11, line 23, after "plastic strings" --with increasing diameter-- should be inserted.

Signed and Sealed this

Second Day of May, 1995

*Attest:*

Bruce Lehman

BRUCE LEHMAN

*Attesting Officer*

*Commissioner of Patents and Trademarks*